United States Patent [19]

Johnson

[11] 3,976,726

[45] Aug. 24, 1976

[54] FUEL ACTIVATION APPARATUS

[75] Inventor: Glen E. Johnson, Denver, Colo.

[73] Assignee: Electro Fuel, Inc., Pierce, Colo.

[22] Filed: Feb. 11, 1974

[21] Appl. No.: 441,694

[52] U.S. Cl. ..... 261/1; 261/DIG. 48; 123/119 E; 60/39.46 R; 431/2

[51] Int. Cl.[2] ..... F02M 27/04

[58] Field of Search ..... 60/39.46, 39.02, 39.06; 261/DIG. 48, 1; 239/102; 123/119 E; 431/2

[56] References Cited

UNITED STATES PATENTS

| | | | |
|---|---|---|---|
| 2,908,443 | 10/1959 | Fruengel | 123/119 E |
| 3,134,948 | 5/1964 | Wilting | 331/114 X |
| 3,464,029 | 8/1969 | Kovalevski | 331/114 X |
| 3,533,606 | 10/1970 | Thatcher | 261/DIG. 48 |

FOREIGN PATENTS OR APPLICATIONS

| | | | |
|---|---|---|---|
| 969,494 | 12/1950 | France | 216/DIG. 48 |

*Primary Examiner*—Carlton R. Croyle
*Assistant Examiner*—Robert E. Garrett
*Attorney, Agent, or Firm*—C. B. Messenger

[57] ABSTRACT

Fuel activation apparatus for use in the pretreatment of fuel that is to be mixed with air for burning in combustion engines and the like. Fuel within a dielectric carrier is subjected through use of a field coil or other means to pulsed energy from an oscillator or other source at a frequency in a range corresponding to resonant frequencies for the molecular components of the fuel, the constituent elements of the fuel or protons of such elements. For fuels having a hydrogen constituent, operation in a frequency range of 16 to 42 Mega Hertz is suggested. For fuels having other inclusions, the operating frequency range may be expanded to include the nuclear resonance frequency for such components.

12 Claims, 3 Drawing Figures

FUEL ACTIVATION APPARATUS

BACKGROUND OF THE INVENTION

Studies connected with the development of the present invention have been directed to the attainment of improved fuel utilization with an attendant reduction in atmospheric pollution characteristics. Desirable and beneficial results obtained have shown better fuel economy as evidenced by improved mileage and a lower level of atmosphere polluting exhaust emissions. The background for the concepts and techniques herein utilized is not found in the field of prior fuel saver or improved combustion developments but instead is more closely related to earlier developments in the fields of chemical analysis, and particularly to earlier studies relating to nuclear magnetic resonance. No previous adaptations from such field for improvement of combustion results are known. Earlier studies and developments in which sound energy or ultrasonic vibrations are imposed on fuel supplies or to activate fuel and air mixtures just prior to combustion are acknowledged. Earlier use of mechanical or magnetically derived excitation effects of the type set forth in the patent to Kwartz, U.S. Pat. No. 3,116,726 are acknowledged. The earlier Kwartz device has a lower operating range, and it would not be effective to obtain nuclear or proton resonance for the fuel components in keeping with the present invention.

SUMMARY OF THE INVENTION

In keeping with the present invention, fuels that may be of a distinct chemical structure, or a mixture of varied molecular components or of separate elemental composition are activated by exposure to pulsed wave energy of radio frequency characteristic. Desirably, a pulsed field is established near the point of fuel combustion that has an output frequency range that will excite the molecular or elemental structure of fuel components or protons of constituent elements. In described embodiments excitation frequencies corresponding to the resonance frequencies for constituent elements are used to activate fuel components just prior to combustion. Beneficial results are also obtained where a mixture of fuel and air or oxygen or a mixture of two separate reacting chemicals are activated at or before the time of reaction. The desired radio frequency excitation may be applied through use of a coil structure or by other means, and such excitation may be used together with or apart from a magnetic field established at the point of fuel excitation. The desired frequency outputs are derived through use of oscillators or other electronic signal generating apparatus or through use of inductance-capacitance circuits coupled to a back e.m.f. derived in a mechanically excited transformer circuit. Specific examples and representative embodiments of the invention are shown and described.

DESCRIPTION OF THE PREFERRED EMBODIMENTS

Figure 1:
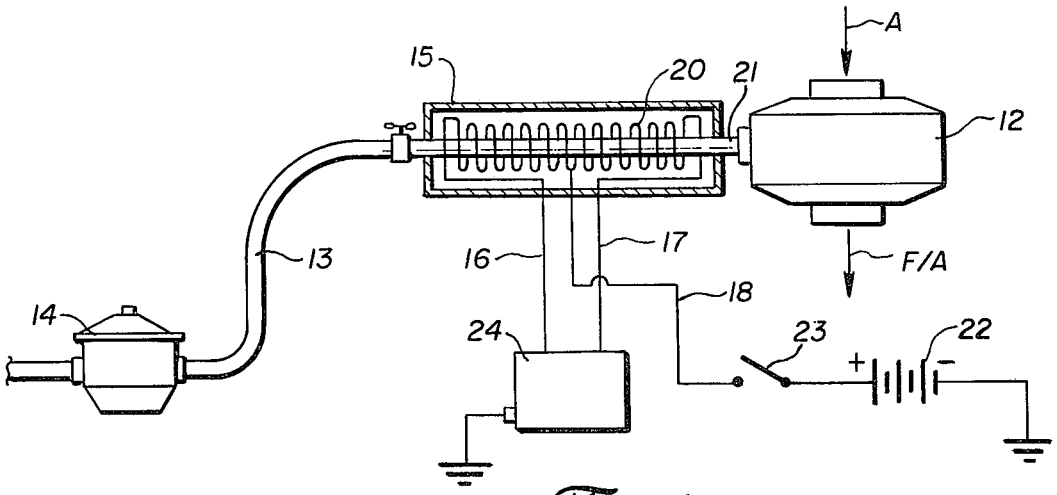
FIG. 1 is a schematic illustration of a first embodiment of the invention.
Figure 2:
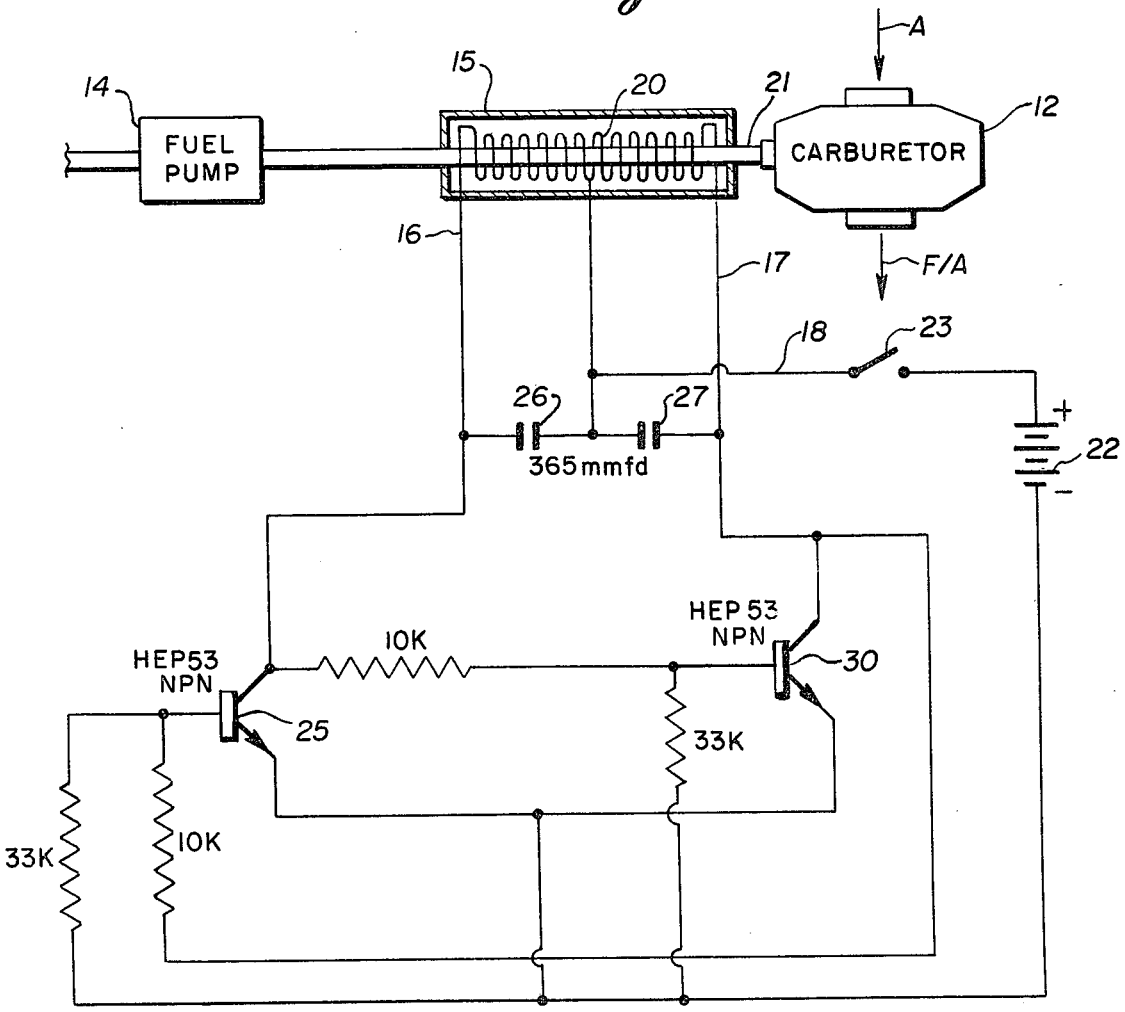
FIG. 2 is a schematic circuit diagram for such embodiment.

In a first embodiment of the invention as presented in FIGS. 1 and 2, the development is adapted for use in connection with the operation of an internal combustion engine. In keeping with such embodiment, the fuel being introduced to the carbureter 12 of the engine (not shown) is subjected to a high frequency excitation as the fuel in the liquid state is being conveyed to points of combustion in the engine. In these drawings only selective components of the engine system are illustrated, but it is to be understood that the illustrated components are used in a conventional manner together with other components of a complete internal combustion engine power plant. For such use a carbureter 12 of the engine system is interconnected by a gas line 13 to a fuel pump 14 which operates to deliver a required quantity of gasoline or other hydrocarbon fuel to the carbureter 12 and through such carbureter into the intake system of the engine along a flow path indicated by the arrow identified by the legend F/A. Intake air is introduced to the carbureter 12 as shown by the arrow bearing the legend A. While the main extent of the gas line 13 may be of metal, rubber or plastic material, a segment 21 thereof disposed within an activator unit 15 is formed of polyethylene, other plastic, glass or other dielectric material, Lead wires 16, 17 and 18 are interconnected to the activator unit 15 and to a coil 20 wrapped about the polyethylene section 21 of the fuel line passing through the activator unit 15. The wire 18 is connected to a center tap on coil 20 which is itself of multi-turn configuration. The ends of the coil 20 are connected to the lead wires 16 and 17. For this installation the coil 20 is formed of No. 18 wire, and the coil has a total of 13 turns between leads 16 and 17. The vehicle battery 22 is connected to the line 18 through a switch 23 so the activator apparatus may be turned on or off.

The activator unit 15, the lead wires 16 and 17 and the coil therein are interconnected to the output of a push-pull oscillator 24 disposed adjacent the fuel line. For this embodiment of the invention the output of this push-pull oscillator provides an average 2½ watt output at a frequency range of 28 to 32 Mega Hertz. This oscillating output energy is delivered to the coil and is impressed through dielectric tube 21 to excite and activate the fuel passing therethrough. The activated fuel is immediately delivered to the carbureter 12 for mixture with incoming air to provide the fuel-air mixture that is then introduced into the engine power plant for compression and burning.

FIG. 2 provides an additional schematic representation of the components and apparatus used in this first embodiment of the invention. Components identified in FIG. 1 are indicated by the same numerals in FIG. 2. Additional electrical and electronic components disposed within the oscillator 24 are schematically presented in FIG. 2. The main components of the push-pull type oscillator 24 are the paired transistors 25 and 30. As indicated, the transistors used are of the NPN type and are available under the trade designation of Hep 53. When used in the present apparatus, these silicon transistors are preferably provided with TO-5 type heat sinks which closely fit the transistor case. Resistances of value as shown are connected in the circuit positions indicated. The output of oscillator 24, inclusive of the separate 365 micro microfarad capacitances 26 and 27 and the associated segments of the coil 20, provides the desired 2½ watt average output at a frequency that is apparently centered at 30 Mega Hz with a general range of from 28 to 32 Mega Hz.

Apparatus made and applied in keeping with the present embodiment of the invention has been used on various automobiles. When applied to the fuel lines of cars and trucks, a significant improvement has been obtained in fuel combustion as evidenced by improved miles per gallon performance. On chassis dynamometer test runs a horsepower increase equivalent to 10 hp S.A.E. was obtained for an eight cylinder engine in the 150 hp class. Exhaust emissions for the automobile were checked in tests run at approximately 2500 engine RPM and under circumstances where no changes were made in mixture or rolling resistance. The percent oxygen in the exhaust discharge increased to a range of from 6 to 12 percent of the discharge, and the unburned hydrocarbons were correspondingly reduced. The previously noted release of nitrous oxides was significantly reduced.

At present a full explanation for the derived beneficial results may not be known, but some explanation therefor may be suggested by earlier studies and developments in the field of nuclear magnetic resonance or electron paramagnetic resonance. Extensive studies have been made in these fields which indicate that the protons and nucleus of separate elements and of molecular compositions can be excited when disposed in a zone of r f influence. Resonance frequencies for may elements have been established, and the resonant excitation of various elements is demonstrable in connection with such studies. Primarily, the earlier work has been directed to the spectral analysis of chemical components and elements so that the composition and chemical structure can be better understood. Such prior studies have indicated that the resonance frequency for hydrogen in a magnetic field of approximately 7 Kilo Gauss is 30 Mega Hz. In a magnetic field of 10 Kilo Gauss the resonance frequency is approximately 42 Mega Hz. For magnetic fields of lesser strength, the resonance frequency for hydrogen is itself correspondingly lower in value.

In general, the gasolines that are commercially sold are a mixture of various hydrocarbons combined in ratios that may be considerably changed from time to time or through various marketing outlets or in different seasons. All of the major gasoline components, however, are hydrocarbons, and, accordingly, hydrogen is a prominant constituent element in gasolines. Commonly occurring carbon has no magnetic resonance characteristic, and, accordingly, the r f fields imposed in present embodiments of the invention are directed to the excitation of the hydrogen component of the fuel. Likewise for present embodiments the excitation field has been applied to the fuel while the fuel is in the liquid state and at a time ahead of its combination in the carbureter to provide the fuel and air mixture. Beneficial results of similar nature might be available if the excitation field is provided in the fuel and air intake channels of the engine or at the combustion chamber itself. It is noted, however, that while commonly occurring oxygen has no resonance magnetic spectra, the nucleus of nitrogen and its isotopes can be excited at even lower frequencies than those for hydrogen. Excitation of the nitrogen in a fuel/air mixture may or may not be desirable.

In connection with this first embodiment of the invention, it is recognized that a center tapped coil is used, and, accordingly, any induced magnetic fields at the zone of r f application in the activator unit 15 may be self-cancelling or reversing. At any rate the applied magnetic field does not attain the field strengths used in nuclear magnetic resonance studies for the establishment of element identifying phase shifts in the derived NMR spectra. Application of the described r f excitation field in the manner set forth does provide a beneficial result which may be independent of a requirement for the establishment of a magnetic field or which, for the described type of installation, may be enhanced by the reversing polarity of the magnetic field provided through use of the center tapped coil.

Figure 3:
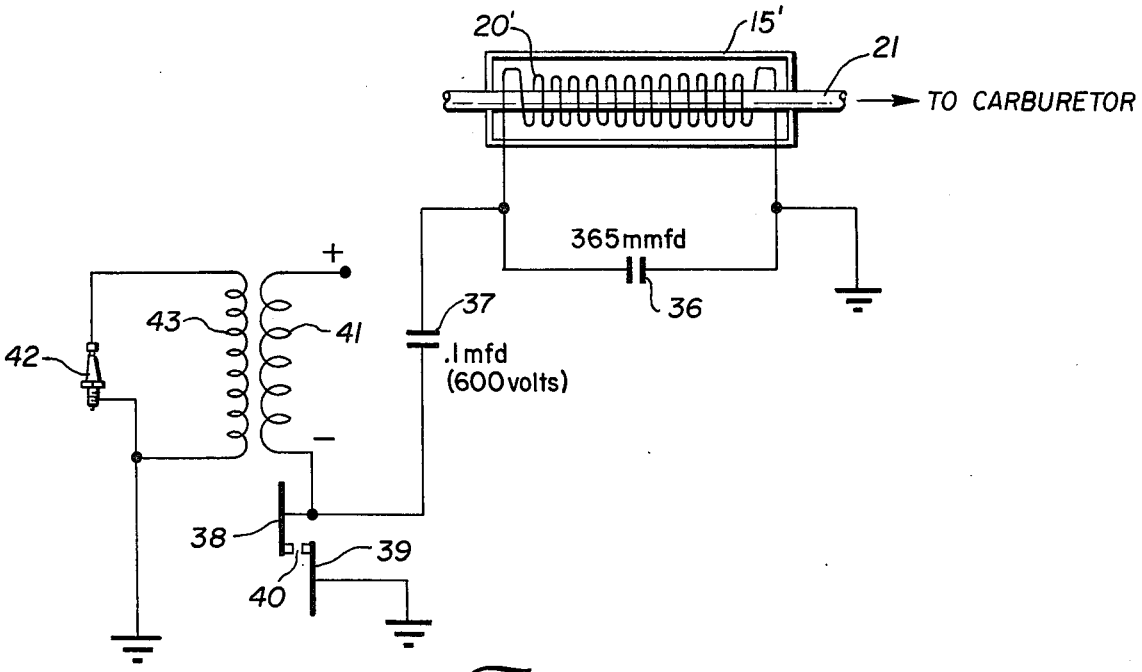
FIG. 3 is a schematic diagram for an alternate embodiment of the invention.

A separate embodiment of the invention is depicted in FIG. 3. Here the activator coil 20' is a continuous 13-turn winding which, accordingly, provides a unidirectional magnetic influence. In this embodiment of the invention the desired zone for application of the r f influence is again disposed within an activator unit 15' positioned about a dielectric fuel line 21. The pulsed discharge used in this embodiment of the invention is dependent on utilization of an inductance-capacitance circuit which includes the multi-turn coil 20' disposed about the fuel line 21 and a single capacitor 36 in parallel with such coil. Capacitor 36 is again of 365 micro microfarad capacity. This LC circuit is connected to ground of the automobile electric system and through a 0.1 micro farad capacitor 37 having a 600 volt rating to a first contact 38 of the ignition points 40 for the automobile. The other contact 39 is again connected to ground. The first contact 38 is connected to the negative side of the primary winding 41 of the ignition coil for the automobile. The sparkplugs 42 of such ignition system are connected to the secondary winding 43 for such ignition coil. For this embodiment of the invention it is a back e.m.f. influence from the primary winding of the coil that is introduced to the basic pulsing LC circuit to obtain the approximate 30 Mega Hz r f zone within the activator 15'. The back e.m.f. has an output at approximately 400 volts.

Beneficial results that are comparable with those obtained in the first embodiment of the invention have been realized through use of this type of installation. From the standpoint of radio interference control and other considerations, the first embodiment is presently preferred. Various shielding devices can, of course, be used to surround the activator unit 15' and any of the other circuits of this embodiment to minimize any radio interference that might result. With respect to this second embodiment of the invention, at least two factors should be additionally noted. First, the activator component is not interconnected in the secondary of the ignition coil, and the frequency of the pulsed energy is not of the same frequency as the make and break functions of the ignition points 40. Secondly, in this embodiment the coil 20' does not have a center tap, and, accordingly, any derived magnetic field will be unidirectional.

While a push-pull type oscillator is shown as a source for the r f influence in FIGS. 1 and 2, many other types of electronic apparatus could be used to provide desired r f outputs in the same frequency range or at higher or lower frequencies, if required. Signal generators are available as stock items that would have a r f output in the desired range. As an example, a General Radio signal generator identified as 805-C provides seven separate output frequency ranges covering a total span from 16 K Hz to 50 M Hz. Photoelectron multipliers and Hot Cathode Arcs can provide signals in the lower 4 to 5 M Hz range that would correspond to the excitation frequencies of nuclear magnetic resonance for nitrogen in a 10 Kilo Gauss field. Since nuclear magnetic resonance studies have been successfully conducted using pulsed energy discharges in the required frequency ranges as well as sign wave and other wave energy discharges, many different r f output circuits and apparatus might be used to obtain the desired results.

Present testing has not yet established the full range for excitation frequencies even where only hydrocarbon fuels are used. Where normal gasolines are concerned, an operative r f frequency range of from 16 to 42 Mega Hz has been determined on an operational output and benefit basis. Related studies, however, have indicated that aromatic fuels have special resonance characteristics of a type that may provide improved operational results over a different or wider range. Since gasolines may seasonally include different percentages of aromatic fuels, operation through a wider range of frequencies may be possible, and optimum results may occur at output frequencies differing from the targeted 30 Mega Hz set forth herein.

It is believed that the same apparatus and procedures herein set forth are also adaptable for use with other petroleum distillates, inclusive of diesel fuel and jet engine fuels. The chemical compositions of such fuels are, of course, similar to that of gasolines, and, accordingly, similar beneficial results are probable. Further, the use of the invention is not restricted to the field of internal combustion engines but instead should be identified with the field of fuel combustion in general. Improved results are possible wherever a fuel is being burned or combined with air, oxygen or other reacting chemicals. The fuel activation apparatus could be used in connection with the operation of internal combustion engines, boilers, heating plants, heat engines, Stirling cycle engines, etc.

It is further acknowledged that the decay life for the fuel activation effects is not known, and, accordingly, beneficial results may be obtained where the activation apparatus is applied at different zones from that shown and described. Maximum benefits might actually be obtained when the apparatus is positioned at locations other than the specific place shown and described herein. Present embodiments, however, are believed to be exemplary of the beneficial results possible in keeping with this invention.

I claim:

1. Activation apparatus for the pretreatment of fuel that is to be combined with oxygen for burning in an exothermic reaction process comprising a power source, a pulsed energy output component connected to said power source and providing radio frequency energy in a frequency range corresponding to a nuclear resonance frequency for at least one elemental constituent of said fuel, an activator unit connected to said output component and disposed in position adjacent the movement path for said fuel to provide a zone of radio frequency interference at frequencies within said frequency range, and means for moving said fuel through said interference zone for the activation thereof prior to its intermixture with oxygen for use in said reaction process.

2. The fuel activation apparatus as set forth in claim 1 wherein the pulsed energy output is in a frequency range of from 16 to 42 Mega Hz.

3. The fuel activation apparatus as set forth in claim 1 wherein the oxygen to be utilized is a constituent of air.

4. The fuel activation apparatus as set forth in claim 3 wherein hydrocarbon fuels are used and further comprising a wound coil as a component of said activator unit disposed about said fuel moving means at said interference zone and providing a magnetic field at said zone.

5. The fuel activation apparatus as set forth in claim 4 wherein the pulsed energy output is in a frequency range of from 16 to 42 Mega Hz.

6. The fuel activation apparatus as set forth in claim 4 wherein the combustion process is associated with a fuel burning engine utilized as a power source.

7. The fuel activation apparatus as set forth in claim 6 wherein said activation apparatus is used with an internal combustion engine.

8. The fuel activation apparatus as set forth in claim 6 wherein the pulsed energy output is in a frequency range of from 16 to 42 Mega Hz.

9. The fuel activation apparatus as set forth in claim 8 wherein the pulsed energy output is in the frequency range of from 28 to 32 Mega Hz.

10. The fuel activation apparatus as set forth in claim 8 wherein the activator unit is inclusive of inductance-capacitance circuits and a wound coil is disposed about said fuel moving means to provide said interference zone.

11. The fuel activation apparatus as set forth in claim 6 wherein the fuel moving means is the fuel line of a combustion engine system, and wherein said fuel line is of dielectric material at said interference zone.

12. The fuel activation apparatus as set forth in claim 8 wherein the wound coil is of center tapped configuration providing reversing magnetic fields at said interference zone.

* * * * *